US008579245B2

(12) United States Patent
Foltz et al.

(10) Patent No.: US 8,579,245 B2
(45) Date of Patent: Nov. 12, 2013

(54) RETAIL PRODUCT ASSEMBLY WITH HANGER

(71) Applicant: Target Brands, Inc., Minneapolis, MN (US)

(72) Inventors: Peter Foltz, Minneapolis, MN (US); Jacob Streich, St. Louis Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/674,536

(22) Filed: Nov. 12, 2012

(65) Prior Publication Data

US 2013/0068923 A1 Mar. 21, 2013

Related U.S. Application Data

(63) Continuation of application No. 12/777,064, filed on May 10, 2010, now Pat. No. 8,308,119.

(51) Int. Cl.
*A47F 5/00* (2006.01)
*A47F 7/00* (2006.01)

(52) U.S. Cl.
USPC ..... 248/314; 248/248; 248/224.7; 248/300; 248/309.1; 248/317

(58) Field of Classification Search
USPC ..... 248/314, 248, 224.7, 300, 309.1, 317; 211/59.1
See application file for complete search history.

(56) References Cited

U.S. PATENT DOCUMENTS 3,302,917 A 2/1967 Winkler
3,310,272 A 3/1967 Brunger
3,680,746 A 8/1972 Seckelmann
3,695,418 A 10/1972 Gwozdz
3,710,996 A 1/1973 Smilow et al.
4,155,531 A 5/1979 Bagne
4,266,677 A 5/1981 Dewsnap
4,682,688 A 7/1987 Budert
4,832,301 A 5/1989 Hiramoto et al.
5,013,004 A * 5/1991 Wilkins et al. ..... 248/692
5,133,455 A 7/1992 Chow
5,279,420 A 1/1994 Rodgers (Continued)

OTHER PUBLICATIONS

Sue Whitney, "How to Make a Quiche Pan," http://www.junkmarketstyle.com/item/5756/how-to-make-a-quiche-pan-frame, Dec. 30, 2008, 7 pages.

*Primary Examiner* — Amy J Sterling
(74) *Attorney, Agent, or Firm* — Griffiths & Seaton PLLC; JoAnn M. Seaton

(57) ABSTRACT

A hanger, for supporting a retail item from a separate support structure, includes a support interface portion, a transverse section, an intermediate section, and a base section. The support interface portion is configured to selectively receive the separate support structure. The transverse section extends from the support interface portion and defines a bottom edge of the transverse section. The intermediate section extends from the transverse section. The base section extends downwardly from the intermediate section. The base section defines two side edges tapered toward one another such that a width of the base section gradually decreases as the base section extends away from the intermediate section. The base section is configured to partially deflect to slide through an elongated opening of the retail item such that during use the intermediate section and the base section are positioned on opposite sides of the elongated opening and the intermediate section extends through the elongated opening.

20 Claims, 9 Drawing Sheets

(56) References Cited

U.S. PATENT DOCUMENTS

| | | | |
|---|---|---|---|
| 5,413,301 | A | 5/1995 | Cadman |
| 5,425,519 | A | 6/1995 | Budert |
| 5,509,528 | A | 4/1996 | Weisburn |
| 5,556,014 | A | 9/1996 | Kolton et al. |
| 5,615,810 | A | 4/1997 | Kolton et al. |
| 5,626,268 | A | 5/1997 | Kolton et al. |
| 6,032,797 | A | 3/2000 | Kao |
| 6,102,461 | A | 8/2000 | Rooney et al. |
| 6,226,911 | B1 | 5/2001 | Wescombe |
| 6,305,655 | B1 | 10/2001 | Van Horn |
| 6,446,932 | B1 | 9/2002 | Butterfield et al. |
| 6,609,693 | B2 | 8/2003 | Hui |
| 7,137,513 | B2 | 11/2006 | Sedon et al. |
| 7,264,213 | B2 | 9/2007 | Liu |
| 7,500,559 | B2 | 3/2009 | Kim |
| 2003/0193005 | A1 | 10/2003 | Hui |

* cited by examiner

RETAIL PRODUCT ASSEMBLY WITH HANGER

CROSS-REFERENCE TO RELATED APPLICATION

This application is a continuation of and claims priority under 35 U.S.C. §120 to U.S. patent application Ser. No. 12/777,064, filed May 10, 2010, which is incorporated herein in its entirety.

BACKGROUND OF THE INVENTION

Retailers are continually evolving product displays in hopes of discovering more effective and visually attractive means for displaying products to potential consumers. The packaging for products may be designed to facilitate product display. For example, given the limited shelf space available in retail stores, it is often desirable to provide product packaging configured to facilitate hanging of products from rods, pegs, or other display fixture support members.

SUMMARY OF THE INVENTION

One aspect of the present invention relates to a hanger for supporting a retail item from a separate support structure, the retail item defines an elongated opening along a rear surface of the retail item, and the elongated opening defines an elongated opening width. The hanger includes a support interface portion, a transverse section, an intermediate section, and a base section. The support interface portion is configured to selectively receive the separate support structure such that the hanger will be suspended from the separate support structure. The transverse section extends from the support interface portion and defines a bottom edge of the transverse section having a transverse section width that is wider than the elongated opening width. The intermediate section extends from the transverse section and defines an intermediate section width that is less than the elongated opening width. The base section extends downwardly from the intermediate section. The base section defines a top edge of the base section adjacent the intermediate section and extends in a direction opposite the intermediate section. The base section defines two side edges tapered toward one another such that a width of the base section gradually decreases as the base section extends away from the intermediate section, and the width of the base section at the top edge is larger than the intermediate section width and the elongated opening width. The base section is configured to partially deflect to slide through the elongated opening such that during use the intermediate section and the base section are positioned on opposite sides of the opening and the intermediate section extends through the opening. The support interface portion, the transverse section, the intermediate section, and the base section are all formed of a single continuous piece of a substantially planar material. Other related products, assemblies and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

Embodiments of the present invention are configured to provide a compact hanging product assembly to be used in retail stores and in similar environments. In one embodiment, a hanger is provided and configured to interact with an existing hanging bracket on a retail item, which is configured to be hung from a wall or similar structure during use by the purchasing or other consumer. For instance, the hanging product assembly includes retail product, such as a wall hanging, house number, or similar retail item, having a saw-tooth or suitable hanging bracket on a back surface thereof. A hanger, according to embodiments of the present invention, includes a tapered portion, for example, in the shape of an arrow, configured to slide through an opening between the hanging bracket and the retail item and support the retail item when an opposite support interface portion of the hanger is hung from a support rod or other separate supporting structure included in a retail display.

Other parts of the hanger are configured to increase the integrity of the hanging product assembly by, for example, decreasing rotation and/or lateral and longitudinal movement of the retail item relative to the hanger. The resulting hanger provides a space saving component for displaying retail items for retail sale and is provided with a relatively small amount of material, which decreases end waste when the hanger is removed from the retail item for end use by a consumer. Other advantages and features of the hanging product assembly are disclosed and/or described in greater detail below.

Figure 1:
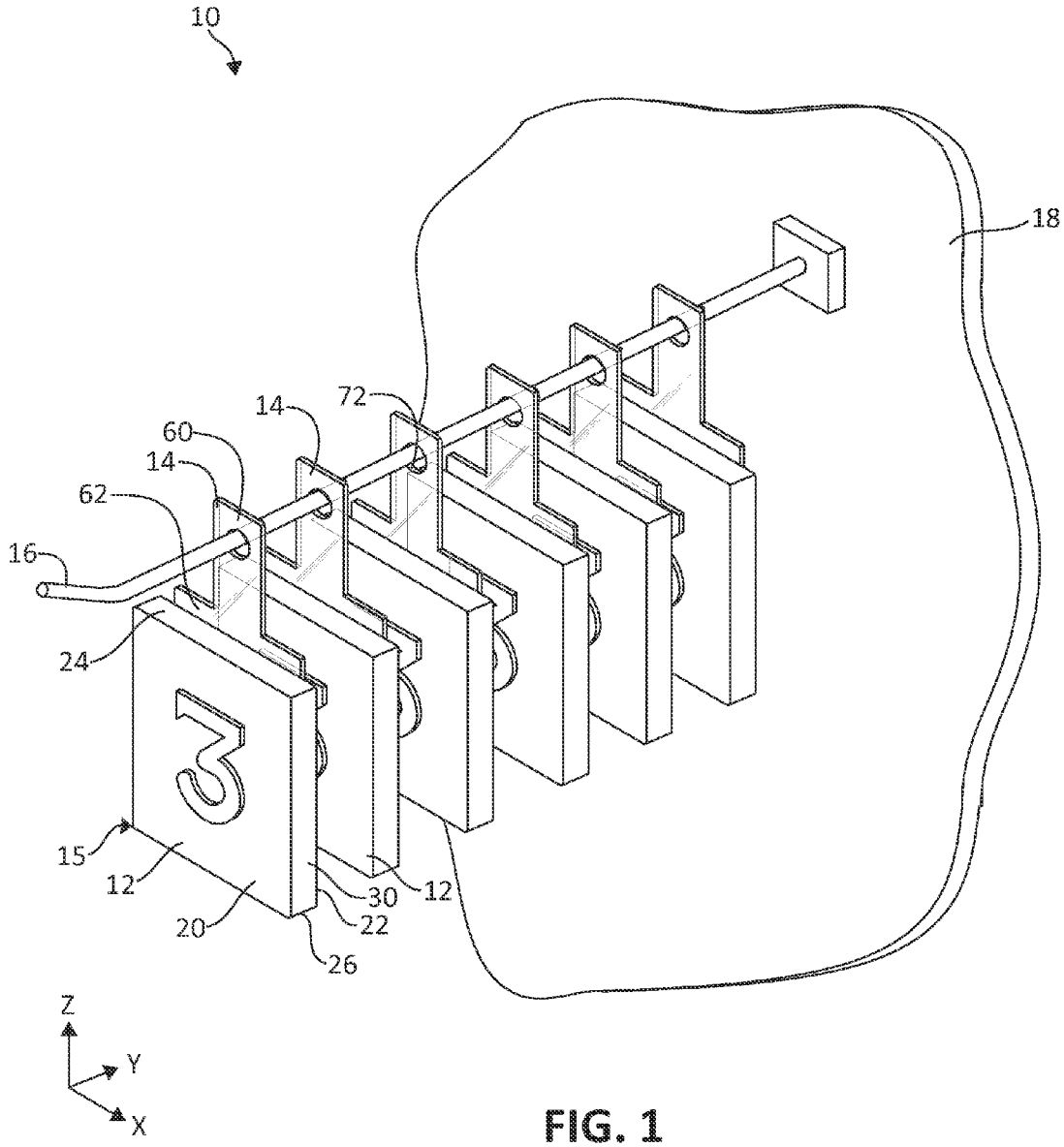
FIG. 1 is a front, perspective view illustration of a plurality of hanging product assemblies hung for retail sale as part of a retail product assembly, according to one embodiment of the present invention.

Turning to the figures, FIG. 1 illustrates one embodiment of a retail display 10 presenting a retail product assembly 15 to potential consumers. In one example, the retail product assembly 15 includes a product or retail product or retail item 12 being offered for sale and a hanger 14 or suspension member. Hanger 14 is configured to facilitate hanging retail item 12 from a retail support such as a retail support rod 16 extending from a supporting wall or structure 18 as illustrated in the example of FIG. 1. In one embodiment, retail product assembly 15 provides a space conscious design for presenting retail item 12 to potential consumers in an aesthetically pleasing manner that is generally free from obstruction of retail item 12 so as not to detract from the overall appearance of retail item 12 as viewed by potential consumers.

Referring to FIGS. 1-4, in one embodiment, retail item 12 defines a front surface 20 and an opposite rear surface 22. Front surface 20 is generally configured to be visible upon end use of retail item 12, for example, when an end consumer hangs retail item 12 on a wall or similar structure during end use. In one example, one or both of front surface 20 and rear surface 22 are substantially planar. In the illustrated embodiment, front surface 20 and rear surface 22 extend substantially parallel to one another and/or are spaced from one another collectively by a topmost sidewall 24, a bottom sidewall 26 opposite topmost sidewall 24, a left sidewall 28, and a right sidewall 30 opposite left sidewall 28. In one example, left sidewall 28 and right sidewall 30 each extend from and between opposite, corresponding ends of topmost sidewall 24 and bottom sidewall 26. In one embodiment, topmost sidewall 24 and bottom sidewall 26 each extend from and between opposite, corresponding ends of left sidewall 28 and right sidewall 30. Referring to FIG. 3B, in one embodiment, retail item 12 defines an overall width $W_{RI}$ and an overall height $H_{RI}$.

Figure 2:
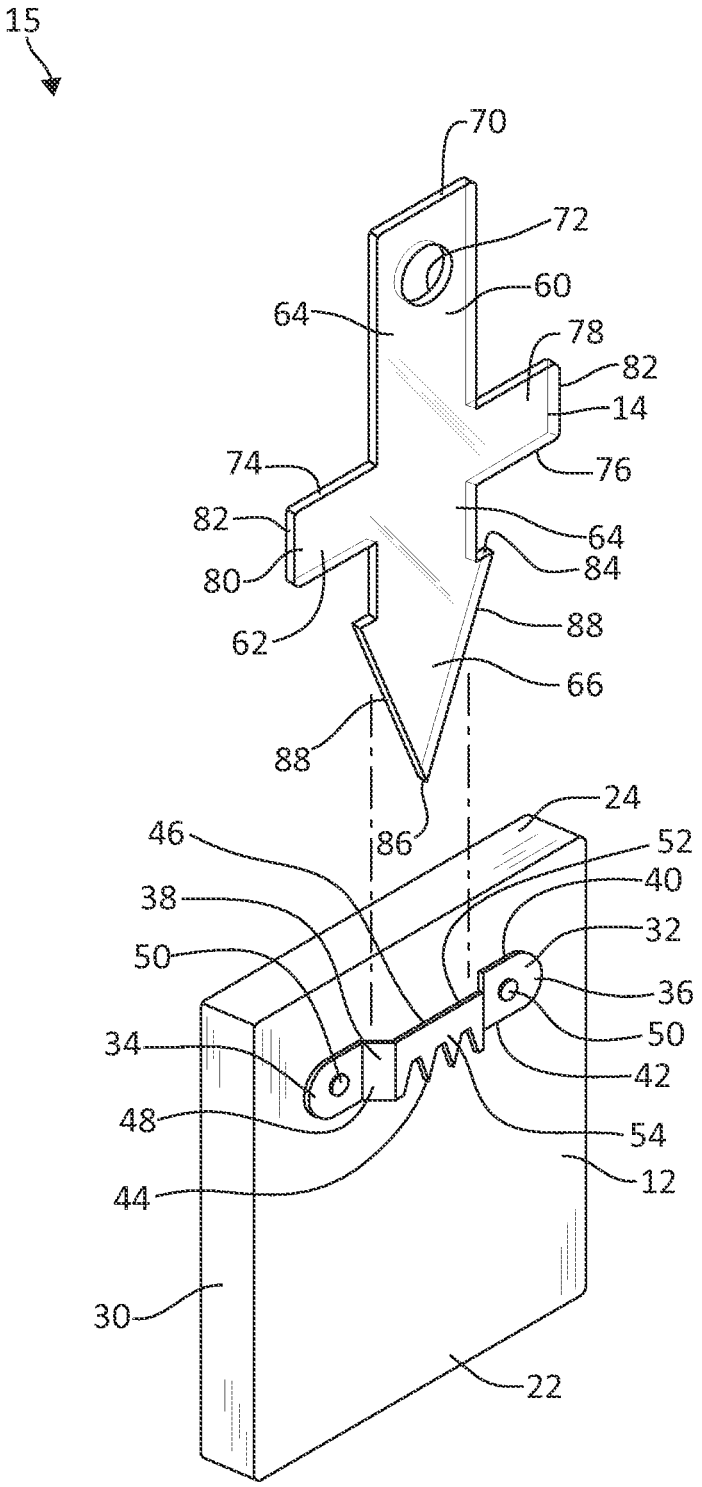
FIG. 2 is a rear, perspective view illustration of one of the hanging product assemblies of FIG. 1, according to one embodiment of the present invention.
Figure 3A:
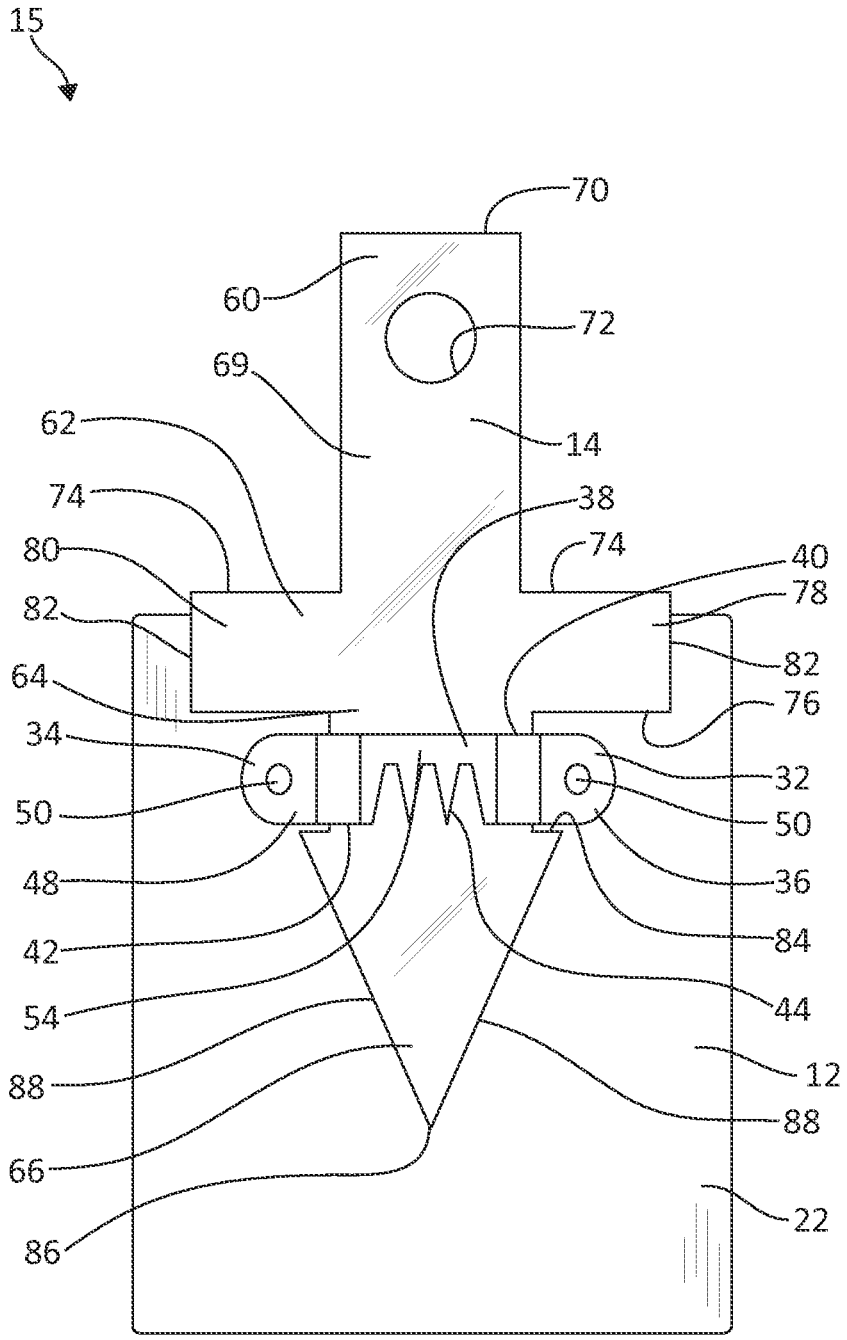
FIG. 3A is a rear view illustration of the hanging product assembly of FIG. 2, according to one embodiment of the present invention.
Figure 3B:
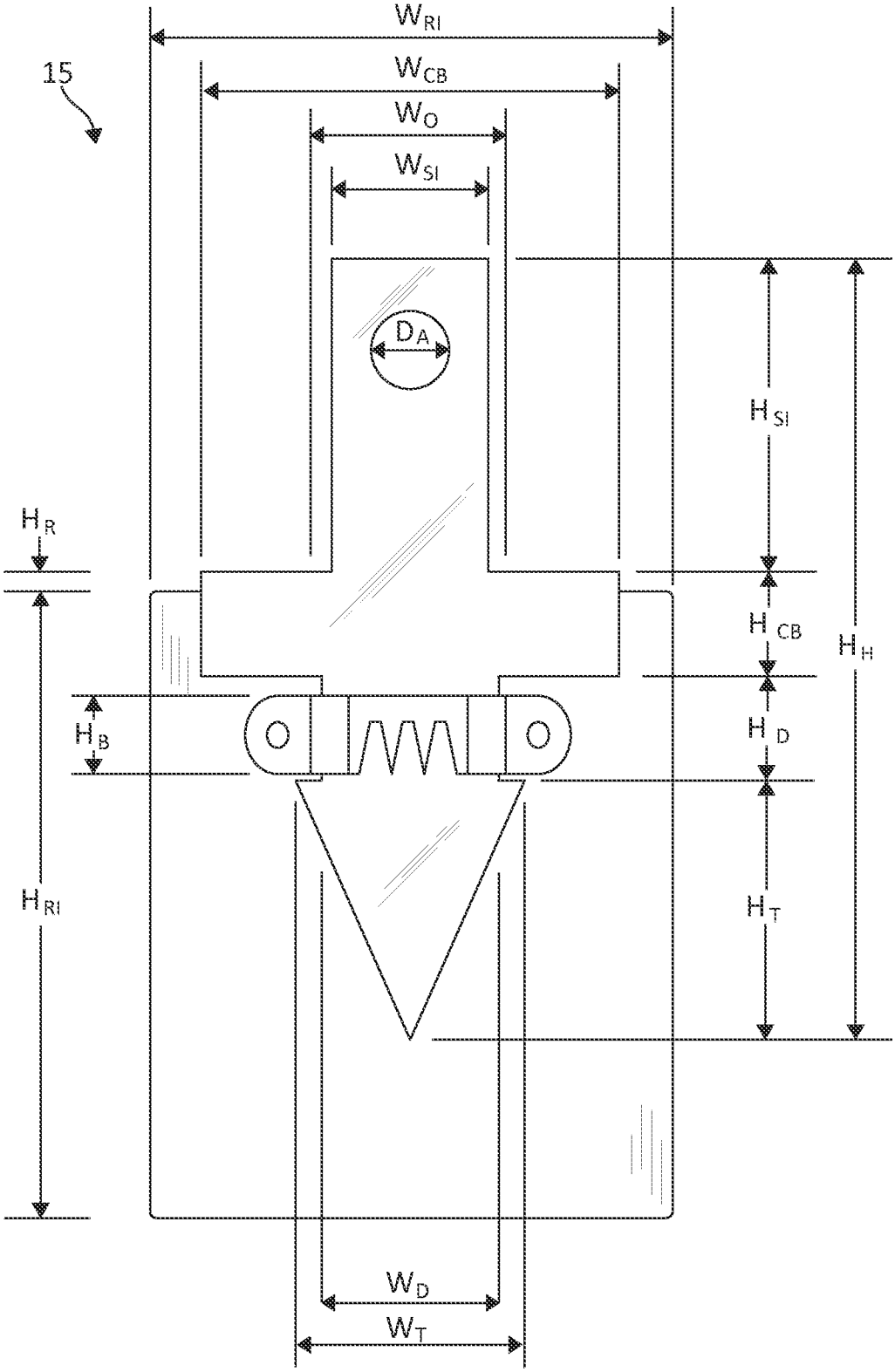
FIG. 3B is the rear view illustration of FIG. 3A with different demarcations for clarity, according to one embodiment of the present invention.
Figure 4:
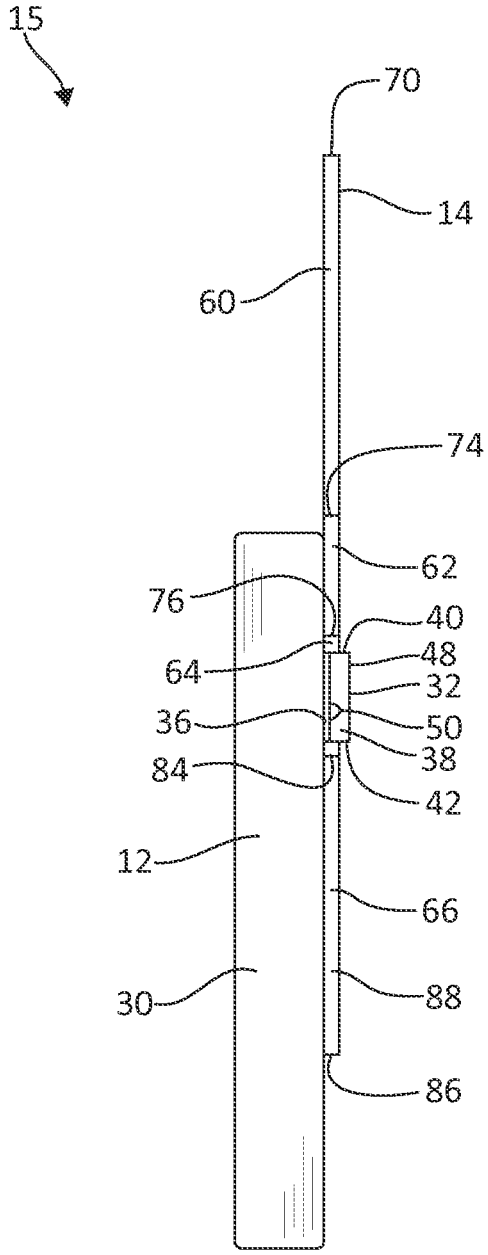
FIG. 4 is a right side view illustration of the hanging product assembly of FIG. 2, according to one embodiment of the present invention.
Figure 5:
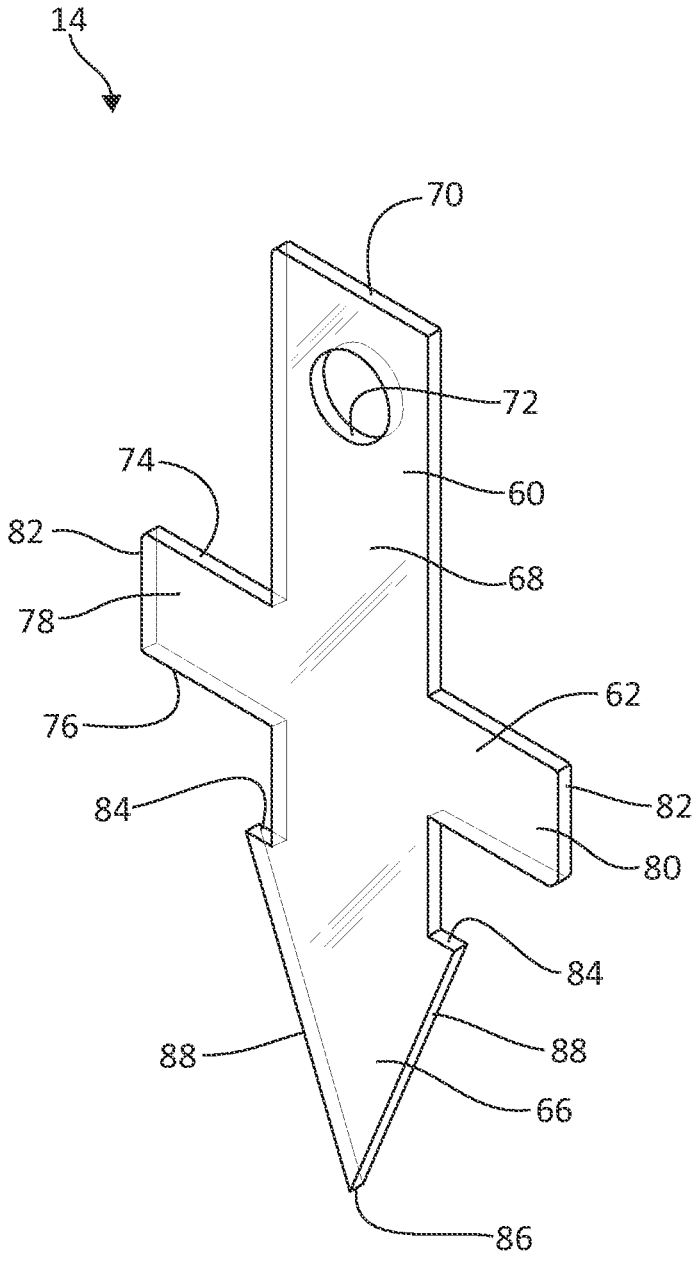
FIG. 5 is a front, perspective view illustration of one of the hangers of the hanger product assemblies of FIG. 1, according to one embodiment of the present invention.
Figure 6:
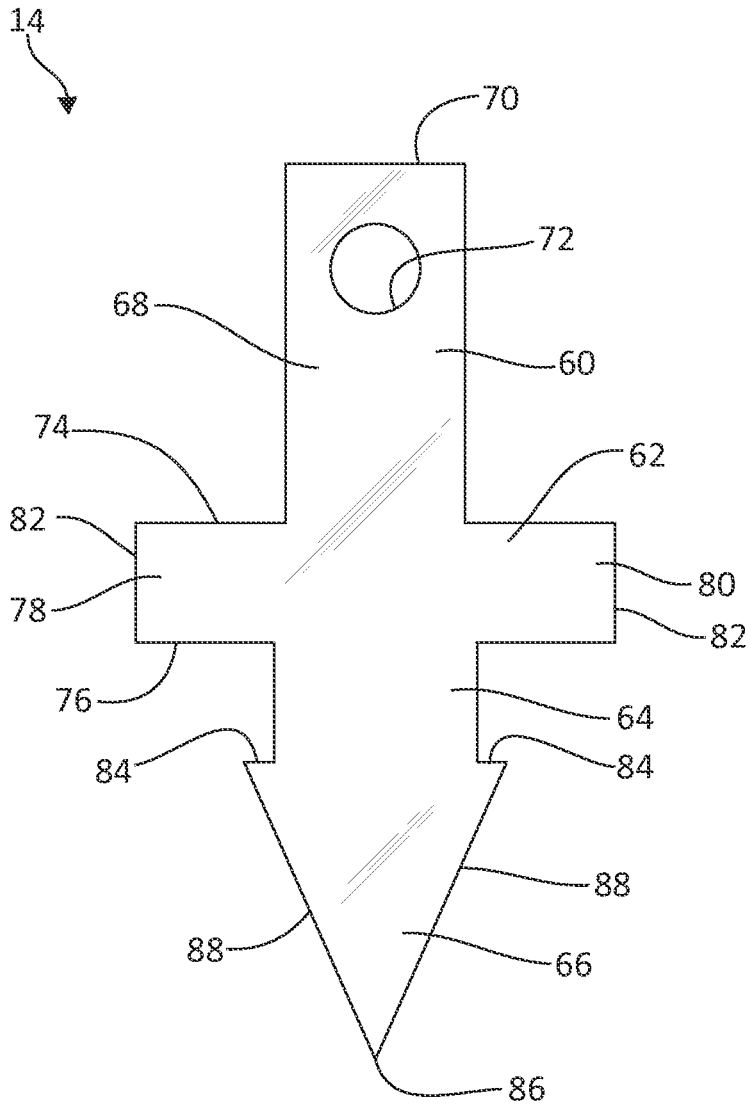
FIG. 6 is a front view illustration of the hanger of FIG. 5, according to one embodiment of the present invention; the rear view of the hanger is identical to the front view.
Figure 7:
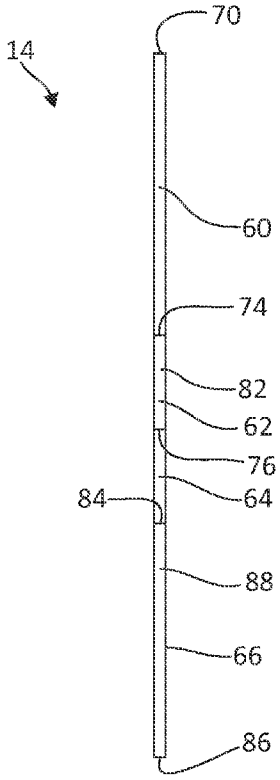
FIG. 7 is a right side view illustration of the hanger of FIG. 5, according to one embodiment of the present invention; the left side view of the hanger is identical to the right side view.
Figure 8:
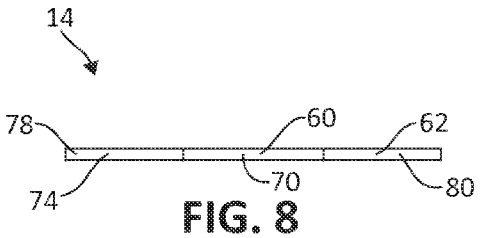
FIG. 8 is a top view illustration of the hanger of FIG. 5, according to one embodiment of the present invention.
Figure 9:
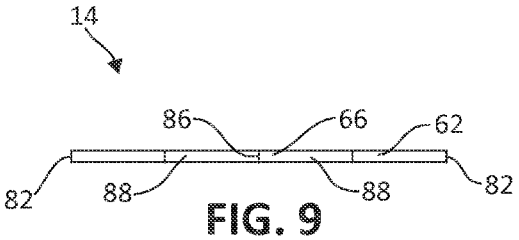
FIG. 9 is a bottom view illustration of the hanger of FIG. 5, according to one embodiment of the present invention.

In one example, a hanging bracket 32, such as the saw-tooth hanger illustrated in FIGS. 2-4, is coupled with rear surface 22 of retail item 12. Hanging bracket 32 may be secured to retail item 12 to facilitate hanging retail item 12 by a consumer following purchase of retail item 12 or may be coupled to rear surface 22 of retail item 12 for the purpose of providing a interface for hanger 14 to interact with retail item 12. In one embodiment, e.g., as illustrated in FIG. 2, hanging bracket 32 is an elongated saw-tooth hanger including a single, elongated, flat piece of metal or other material defining a first end 34, a second end 36 opposite the first end 34, a front surface 46 (FIG. 2), and a rear surface 48 opposite the front surface 46. In one example, hanging bracket 32 is secured to retail item 12 via suitable attachment members 50, e.g., nails, screws, rivets, each extending through one of first end 34 and second end 36 of hanging bracket 32. In one embodiment, hanging bracket 32 is glued, welded, or otherwise coupled with retail item 12, and attachment members 50 are eliminated.

Hanging bracket 32 is bent rearwardly along a metal portion thereof to form a U-shaped portion 38 positioned between first end 34 and second end 36. More particularly, in one embodiment, U-shaped portion 38 is positioned substantially mid-way between first end 34 and second end 36. In one example, U-shaped portion 38 defines a substantially linear mid-section 54 that extends substantially parallel to each of first end 34 and second end 36. Hanging bracket 32 defines a top edge 40 and a bottom edge 42 opposite top edge 40. In one embodiment, hanging bracket 32 includes serrations or cutouts forming upwardly extending teeth 44 along a portion of bottom edge 42 defined along mid-section 54 of U-shaped portion 38. Teeth 44 are configured to receive a nail, screw, anchor, or other hanging device between any two adjacent teeth 44 to facilitate hanging of retail item 12 by a consumer.

In one example, each of first end 34 and second end 36 is coupled with rear surface 22 of retail item 12 such that U-shaped portion 38 extends rearwardly away from rear surface 22 of retail item 12 defining a relatively thin opening 52 (e.g., a gap or slot) between rear surface 22 of retail item 12 and front surface 46 of hanging bracket 32, more particularly, a portion of front surface 46 defined by U-shaped portion 38. Opening 52 allows a nail or screw head, etc. to be relatively easily received during end use as will be apparent to those of skill in the art. In one embodiment, hanging bracket 32 is a standard saw-tooth hanger for picture frames and similar items.

FIGS. 5-9 illustrate various views of hanger 14, which, as described above, is configured to support retail item 12 from support rod 16 or similar structure as part of retail display 10 (see FIGS. 1-4). In one example, hanger 14 is formed from a single piece of a substantially planar material and defines a front surface 68 and a rear surface 69 (FIG. 3A) opposite front surface 68. In one embodiment, each of front surface 68 and rear surface 69 are substantially planar. In one example, hanger 14 is formed with a thickness defined between front surface 68 and rear surface 69 of about 0.4-0.8 mm, and in one example, of about 0.4-0.5 mm, or other suitable thickness to fit within opening 52 between retail article 12 and hanging bracket 32.

In one embodiment, hanger 14 includes support interface portion 60, cross bar 62, drop portion 64, and arrow or tapered portion 66. Support interface portion 60 (otherwise referred to as hanging section) is configured to receive support rod 16 (FIG. 1) or other suitable support structure of retail display 10 (FIG. 1). In one example, support interface portion 60 defines a topmost edge 70 of hanger 14 and extends downwardly from topmost edge 70 to a top edge 74 of cross bar 62 to define a height $H_{SI}$ of support interface portion 60. An aperture 72 is defined through support interface portion 60 between topmost edge 70 and cross bar 62. In one example, aperture 72 is sized (e.g., with a diameter $D_A$) and shaped to receive support rod 16 or other support structure such that hanger 14 can be suspended therefrom. In the illustrated embodiment, aperture 72 is substantially circular and entirely formed in an interior of support interface portion 60 spaced from the edges thereof. However, use of an aperture 72 with a different shape, an aperture 72 that extends to a side edge of support interface portion 60, and/or support interface portion 60 shaped as a hook or in a similar manner are also contemplated.

In one embodiment, support interface portion 60 defines a width $W_{SI}$ that is substantially less than a width $W_{CB}$ defined by cross bar 62 (see FIGS. 3A and 3B). For example, width $W_{SI}$ of support interface portion 60 is less than about half width $W_{CB}$ of cross bar 62, and in one example, is equal to about one third of width $W_{CB}$ of cross bar 62. Support interface portion 60 defines height $H_{SI}$ configured to space retail item 12 from support rod 16 (FIG. 1) a desired distance to create sufficient clearance for aesthetic and functional reasons while, in one embodiment, being maintained fairly close to support rod 16 to avoid use of excess display area.

Cross bar 62 (otherwise referred to as transverse section) extends transversely with respect to, e.g., substantially perpendicular to, the longitudinal extension of support interface portion 60, and in one embodiment, extends evenly on either side of support interface portion 60 in a substantially symmetrical manner. For example, cross bar 62 effectively defines a first extension 78, e.g. a left extension, and a second extension 80, e.g., a right extension, extending on either side of hanger 14, for instance, beyond the lateral edges of support interface portion 60. In one embodiment, width $W_{CB}$ of cross bar 62 is greater than a width of U-shaped portion 38 of hanging bracket 32, and in one example, is substantially equal to or greater than an overall width of hanging bracket 32. In one embodiment, width $W_{CB}$ of cross bar 62 is greater than an overall width of hanging bracket 32 but is less than width $W_{RI}$ of retail item 12.

Cross bar 62 defines a bottom edge 76 opposite top edge 74. A height $H_{CB}$ of cross bar 62 is defined between bottom edge 76 and top edge 74 and, in one embodiment, is selected to provide a relatively rigid cross bar 62 such that any warping or rotational tendency of cross bar 62 is lessened. In one embodiment, height $H_{CB}$ of cross bar 62 is substantially equal to a distance between top edge 40 of hanging bracket 32 and topmost sidewall 24 of retail item 12. When cross bar 62 is so sized, hanger 14 generally prevents or at least decreases front-to-rear rotation of retail article 12 about hanger 14, for example, about an axis extending in an X-direction as indicated in FIG. 1.

Drop portion 64 (otherwise referred to as intermediate section) extends from bottom edge 76 of cross bar 62 downwardly to tapered portion 66. In one embodiment, drop portion 64 defines a width $W_D$ that is substantially equal to or greater than width $W_{SI}$ of support interface portion 60. Width $W_D$ is sized to be at least slightly smaller than a width $W_O$ of opening 52 between rear surface 22 of retail item 12 and U-shaped portion 38 of hanger 14. In one embodiment, drop portion 64 has a substantially rectangular shape, however, other suitable shapes are also contemplated.

Drop portion 64 extends from cross bar 62 to a top edge 84 of tapered portion 66 to define a height $H_D$. In one example, height $H_D$ of drop portion 64 is sized to be just slightly larger than a height $H_B$ of hanging bracket 32. Upon final assembly, at least a portion of drop portion 64 will extend through opening 52 between hanging bracket 32 and retail item 12 as will be further described below.

Tapered portion 66 (otherwise referred to as arrow portion or base section) is generally in the shape of an arrow or is otherwise tapered as it extends from drop portion 64 downwardly toward a bottom 86 of tapered portion 66 and/or hanger 14. In one example, tapered portion 66 includes two opposing angled side edges 88 that converge toward one another as tapered portion 66 extends from top edge 84 to bottom 86. In one embodiment, the convergence of side edges 88 forms bottom 86 as a point with side edges 88 intersecting one another. In one embodiment, side edges 88 do not intersect and a flat or otherwise shaped edge forms bottom 86 of hanger 14. In one embodiment, tapered portion 66 is solid without any slits, slots, or openings formed between side edges 88.

In one example, the widest part of tapered portion 66 is defined at top edge 84. At top edge 84, a width $W_T$ is defined and is, at least initially, slightly wider than opening 52 defined between rear surface 22 of retail item 12 and hanging bracket 32, in particular, U-shaped portion 38 of hanging bracket 32. In one example, top edge 84 of tapered portion 66 is continuously defined other than where tapered portion 66 directly borders drop portion 64, which effectively forms two shoulders for interacting with hanging bracket 32. As tapered portion 66 tapers, it becomes less wide and, in particular, less wide than opening 52 defined between rear surface 22 of retail item 12 and hanging bracket 32. In one embodiment, $W_T$ of top edge 84 of tapered portion 66 is between about 40% of and about 80% of width $W_{CB}$ of cross bar 62. A height $H_T$ of tapered portion 66 is defined between top edge 84 of tapered portion 66 and bottom 86 of hanger 14, e.g., between top edge 84 and a point of tapered portion 66. Height $H_T$ of tapered portion 66 can be selected for any one of a variety of reasons, and in one embodiment, is determined in view of width $W_T$ of arrow portion and to provide sufficient length for side edges 88 to converge toward one another as desired.

In one embodiment, hanger 14 defines an overall height $H_H$ of hanger 14 that is equal to the sum of height $H_{SI}$ of support interface portion 60, height $H_{CB}$ of cross bar 62, height $H_D$ of drop portion 64, and height $H_T$ of tapered portion 66 as illustrated in FIG. 3B. In one example, width $W_{CB}$ of cross bar is equal to the overall width of hanger 14. In one embodiment, height $H_T$ of tapered portion 66 is equal to or greater than about 25% of height $H_H$ of hanger 14. In this manner, tapered portion 66 and cross bar 62 collectively interact with retail item 12 to decrease rotation about an axis extending at least partially in the X-direction (FIG. 1). In view of the properties of hanger 14 described above and below, in one embodiment, hanger 14 is formed from a single continuous piece of, e.g., cut from a sheet of, a substantially planar material, such as polyethylene terephthalate (PET), acrylic, other plastic, or other suitable material. In one example, hanger 14 is formed of PET such that hanger 14 is readily recyclable along with soft drink and water bottles, which are readily accepted for recycling at a great majority of plastic recycling centers, such that the environmental imprint of hangers 14 can be lessened.

Figure 10:
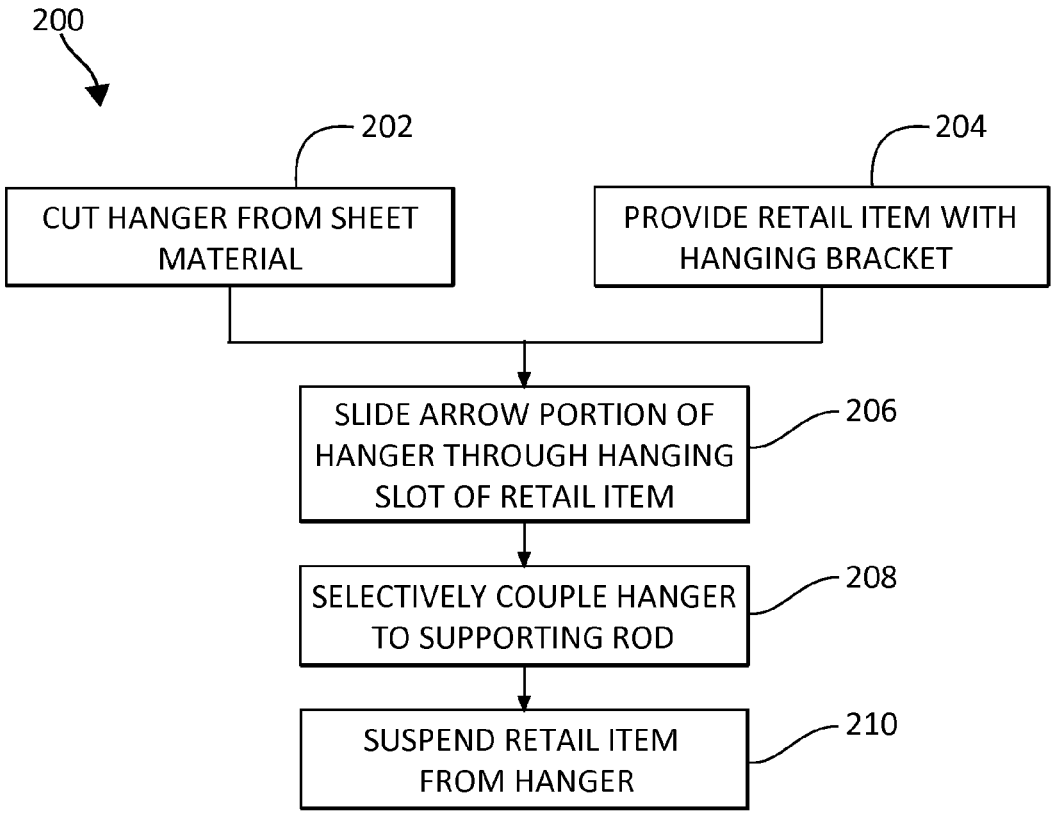
FIG. 10 is a flow chart illustrating of a method of assembling and displaying a hanging product assembly, according to one embodiment of the present invention.

FIG. 10 is a flow chart illustrating one example of a method 200 of manufacturing and assembling retail product assembly 15 as illustrated in FIGS. 1-4. At 202, hanger 14 is cut from a sheet of plastic (e.g., PET) or other suitable material such that the resultant hanger 14 is formed as a single contiguous piece. Meanwhile, at 204, which occurs substantially at the same or at a different time than operation 202, retail item 12 is provided with hanging bracket 32. Notably, while primarily described herein as including hanging bracket 32, in one embodiment, retail item 12 is otherwise formed to define opening 52 on rear surface 22 thereof without separate hanging bracket 32 as will be apparent to those of skill in the art upon reading the present application.

At 206, hanger 14 and retail item 12 are assembled to collectively define retail product assembly 15. For example, referring to FIG. 2, hanger 14 is positioned with tapered portion 66 pointing downwardly and aligned with opening 52 formed between rear surface 22 of retail item 12 and front surface 46 of U-shaped portion 38 of hanging bracket 32. Hanger 14 is slid toward retail item 12 and/or vice versa such that tapered portion 66 moves through opening 52 defined by retail item 12. Since in one embodiment, width $W_T$ of tapered portion 66 is slightly larger than width $W_O$ of opening 52 defined by retail item 12 at top edge 84 of tapered portion 66, downward force is applied to hanger 14 relative to retail item 12 forcing angled side edges 88 of tapered portion 66 to interact with hanging bracket 32, thereby, causing slight deflection in tapered portion 66. The deflection of tapered portion 66 allows top edge 84 of tapered portion 66 to move through opening 52 of retail item 12 and drop portion 64 to extend at least partially through opening 52.

Once tapered portion 66 moves entirely through and clears hanging bracket 32, the force that induced tapered portion 66 to slightly deflect is removed, and as a result, tapered portion 66 returns to its original un-deflected state due to its at least partial elastomeric or biased nature effectively locking hanger 14 in place relative to hanging bracket 32. Further movement of hanger 14 relative to hanging bracket 32 is generally prevented by cross bar 62 interaction with top edge 40 of hanging bracket 32 since width $W_{CB}$ is larger than width $W_O$ of opening 52. As such, upon final positioning, drop portion 64 extends through opening 52. In one embodiment, opening 52 is relatively thin front to back such that front surface 68 of hanger 14 faces and interacts with rear surface 22 of retail item 12, and rear surface 69 of hanger 14 faces and interacts with front surface 46 of hanging bracket 32.

Once retail product assembly 15 is assembled, hanger 14 is placed on support rod 16 or similar structure at 208. For example, hanger 14 is placed such that aperture 72 selectively receives support rod 16. Upon release of retail item 12, at 210, retail product assembly 15 is suspended from support rod 16 via hanger 14 as illustrated with additional reference to FIG. 1. Since hanger 14 is relatively thin and does not add any width to retail product 12 with hanging bracket 32 (see FIG. 4), hanger 14 is desirable due at least in part to its compact nature and the fact that it does not require additional support rod length to accommodate hanger 14. Support interface portion 60 is configured to be sized as desired to space retail item 12 from support rod 16 in an aesthetically pleasing manner and/or to provide space for receiving a label (not shown) or other promotional or instructional indicia. In one embodiment, only support interface portion 60 and, in one example, a portion of cross bar 62 are visible from a front side of retail product 12 once retail product assembly 15 is hung in the retail display.

The various components of hanger 14 are sized and shaped to provide a stable support for retail item 12. For example, in one embodiment, cross bar 62 is formed such that its width $WC_B$ is longer than width $W_O$ of opening 52 between rear surface 22 and front surface 46 defines by U-shaped portion 38 of hanging bracket 32 and, in one embodiment, is wider than the overall width of hanging bracket 32. In this manner, if retail article 12 is nudged or otherwise moved on hanger 14, cross bar 62 interacts with top edge 40 of hanging bracket 14 to decrease the amount of rotation of retail article 12 in an up-and-down direction, e.g., about an axis at least partially extending in a Y-direction (FIG. 1), relative to hanger 14. In one example, width $WC_B$ of cross bar 62 is less than an overall width $W_{RI}$ of retail item to provide a more aesthetically pleasing retail display in which cross bar 62 is not generally visible along either of first sidewall 28 an second sidewall 30 when retail product assembly 15 is viewed from a front perspective.

In one embodiment, height $H_{CB}$ of cross bar 62 is substantially equal to a distance between top edge 40 of hanging bracket 32 and topmost sidewall 24 of retail item 12. When cross bar 62 is so sized, a large portion of cross bar 62, for example, at least a majority of cross bar 62 is able to directly interact with rear surface 22 of retail item 12, such that hanger 14 generally prevents or at least decreases front-to-rear rotation, e.g., about an axis at least partially extending in the X-direction (FIG. 1), of retail article 12 about hanger 14. In one embodiment, a majority of cross bar 62 is hidden by retail article 12 when retail product assembly 15 is viewed from a front side of retail item 12 opposite hanger 14.

In one embodiment, drop portion 64 defines height $H_{DP}$ to accommodate height $H_B$ of hanging bracket 32 when hanger 14 is placed through opening 52 as illustrated in FIGS. 3A, 3B, and 4. In one embodiment, height $H_{DP}$ of drop portion 64 is just slightly larger than height $H_B$ of hanging bracket 32, for example, is less than 20% larger than height $H_B$ of hanging bracket 32. This relatively close correlation in heights, allows cross bar 62 and top edge 84 of tapered portion 66 to each fit relatively snugly or tightly to opposing edges of hanging bracket 32 to decrease rotation of retail item 12 relative to hanger 14, e.g., about an axis at least partially extending in a Y-direction (FIG. 1).

In one embodiment, drop portion 64 is defined with width $W_{DP}$ that is just slightly smaller than width $W_O$ of opening 52, for example, is greater than about 90% of width $W_O$. In this manner, drop portion 64 fits snugly within opening 52 and side edges of drop portion 64 interact with front surface 46 of hanging bracket 32, e.g., of U-shaped portion 38, in a manner decreasing rotational movement of retail article 12 relative to hanger 12, e.g., about an axis at least partially extending in a Y-direction (FIG. 1), upon any inadvertent consumer or employee interaction with retail article 12. As described above, tapered portion 66 is defined with width $W_T$ that is slightly larger than width $W_O$ of opening 52 such that once tapered portion 66 is positioned below hanging bracket 32 and hanger 14 is hung from support rod 16, interaction between top edge 84 of tapered portion 66 and hanging bracket 32 suspends retail item 14. In one embodiment, width $W_T$ of arrow portion is about 15-20% larger than width $W_O$ of opening 52. However, width $W_T$ of tapered portion 66 is sufficiently small such that deflection of tapered portion 66 allows tapered portion 66 to slide through opening 52 upon assembly of retail product assembly 15.

Use of hanger 14 is particularly advantageous on relatively small size and small weight retail items 12. In one embodiment, width $W_T$ of tapered portion 66 is equal to at least about 50% of an overall width of hanger 14, e.g., width $W_{CB}$ of cross bar 62, to increase the stability of resulting retail product assembly 15 (FIGS. 1-4). In one example, to further increase stability of retail product assembly 15, height $H_T$ of tapered portion 66 is equal to or greater than about 25% of the height $H_H$ of hanger 14 as a whole. Although primarily described with respect to retail item 12 having a single hanging bracket 32, those of skill in the art will understand after reading this application that this innovation could be applied using multiple hangers 14 each interacting with a different one of a plurality of hanging brackets 32 on rear surface 22 of retail item 12.

In one embodiment, each of the various portions of hanger 14 (i.e., support interface portion 60, cross bar 62, and drop portion 64) except tapered portion 66 are generally rectangular in shape in part to provide linear edges for interaction with hanging bracket 32. For example, bottom edge 76 of cross bar 64 and top edge 84 of tapered portion 66 are each formed in a substantially linear manner to evenly interact with the generally linear top edge 40 of hanging bracket 32. Similarly, side edges of drop portion 64 are substantially linear and, in one example, are parallel to one another and/or perpendicular to bottom edge 76 of cross bar 64 to simplify interaction with hanging bracket 32 within opening 52 thereof. In view of the above size and shape considerations, hanger 14 and retail item 12 are provided to collectively form a compact retail product assembly 15 with sufficient stability for hanging as part of retail display 10 on view and configured for interaction with a plurality of consumers. Hanger 14 provides an aesthetically pleasing, non-obtrusive device for consistently supporting retail item 12 for sale that interfaces with an existing hanging bracket 32 or other structure on retail item 12 and uses very little material, which in one embodiment is readily recyclable. As such, hanger 14 is effective, visually appealing, and environmental conscious solution to placement of retail items 12 in a retail display.

Although the invention has been described with respect to particular embodiments, such embodiments are for illustrative purposes only and should not be considered to limit the invention. Various alternatives and modifications within the scope of the invention in its various embodiments will be apparent to those with ordinary skill in the art.

What is claimed is:

1. A hanger for supporting a retail item from a separate support structure, the retail item defining an elongated opening along a rear surface of the retail item, the elongated opening defining an elongated opening width, the hanger comprising:

a support interface portion configured to selectively receive the separate support structure such that the hanger will be suspended from the separate support structure;

a transverse section extending from the support interface portion and defining a bottom edge of the transverse section having a transverse section width that is wider than the elongated opening width;

an intermediate section extending from the transverse section and defining an intermediate section width that is less than the elongated opening width; and a base section extending downwardly from the intermediate section, wherein the base section defines a topmost edge of the base section adjacent the intermediate section and extends in a direction opposite the intermediate section, the base section defines two side edges extending from the topmost edge and being tapered toward one another such that a width of the base section gradually decreases as the base section extends away from the intermediate section, the width of the base section at the topmost edge is larger than the intermediate section width and the elongated opening width, and the base section is configured to partially deflect to slide through the elongated opening such that during use the intermediate section and the base section are positioned on opposite sides of the elongated opening and the intermediate section extends through the elongated opening;

wherein the topmost edge of the base section extends continuously between each of the two side edges and the intermediate section such that the topmost edge of the base section is free from any slits, slots, and openings between the two side edges, and the topmost edge is a free edge between each of the two side edges and the intermediate section.

2. The hanger of claim 1, wherein the support interface portion, the transverse section, the intermediate section, and the base section are all formed of a single continuous piece of a substantially planar material.

3. The hanger of claim 1, wherein the intermediate section defines a bottom edge of the intermediate section opposite the bottom edge of the transverse section, the intermediate section is substantially rectangularly shaped and is sized to fit through the elongated opening, the intermediate section defines an intermediate section width substantially smaller than the transverse section width and the elongated opening width, and the intermediate section defines an intermediate section height from the bottom edge of the transverse section to the bottom edge of the transverse section.

4. The hanger of claim 3, wherein the base section defines a base section height that is greater than the intermediate section height.

5. The hanger of claim 1, wherein the topmost edge of the base section has a top-edge width that is at least equal to half an overall width of the hanger.

6. The hanger of claim 5, wherein the overall width of the hanger is equal to the transverse section width.

7. A combination comprising:

a retail item defining a rear surface and a topmost sidewall;

a hanger for supporting the retail item from a separate support structure, the retail item defining an elongated opening along the rear surface of the retail item, the elongated opening defining an elongated opening width, the hanger comprising:

a support interface portion configured to selectively receive the separate support structure such that the hanger will be suspended from the separate support structure;

a transverse section extending from the support interface portion and defining a bottom edge of the transverse section having a transverse section width that is wider than the elongated opening width;

an intermediate section extending from the transverse section and defining an intermediate section width that is less than the elongated opening width;

a base section extending downwardly from the intermediate section, wherein the base section defines a top edge of the base section adjacent the intermediate section and extends in a direction opposite the intermediate section, the base section defines two side edges tapered toward one another such that a width of the base section gradually decreases as the base section extends away from the intermediate section, the width of the base section at the top edge is larger than the intermediate section width and the elongated opening width and the base section is configured to partially deflect to slide through the elongated opening such that during use the intermediate section and the base section are positioned on opposite sides of the elongated opening and the intermediate section extends through the elongated opening; and a hanging bracket defining a front surface coupled with the rear surface of the retail item below the topmost sidewall of the retail item;

wherein:

the hanging bracket bends away from the rear surface of the retail item to define the elongated opening between the rear surface of the retail item and the front surface of the hanging bracket, and the hanging bracket defines a bracket height, a bracket width, and a bottom edge.

8. The combination of claim 7, wherein:

the transverse section defines a bottom edge that is wider than the hanging bracket width, the transverse section is positioned just above the hanging bracket, at least a portion of the transverse section is positioned below the topmost sidewall of the retail item such that at least the portion of the transverse section is hidden from view when the retail item is viewed from a side of the retail item opposite the hanger, the drop portion is positioned between the front surface of the hanging bracket and the rear surface of the retail item and has a height at least equal to the bracket height, and the base section interacts with the bottom edge of the hanging bracket to hold the retail item in a suspended manner via the hanging bracket when the suspension member receives the separate support structure.

9. The combination of claim 8, wherein the intermediate section defines a height that is greater than the bracket height.

10. The hanger of claim 1, wherein:

the transverse section defines a topmost edge opposite the bottom edge of the transverse section, and the topmost edge of the transverse section is substantially parallel to each of the bottom edge of the transverse section and the topmost edge of the base section.

11. The hanger of claim 10, wherein:

the intermediate section defines opposing side edges, the intermediate section width is defined between the two opposing side edges of the intermediate section, and the opposing side edges of the intermediate section each extend substantially perpendicularly relative to the topmost edge of the transverse section.

12. The hanger of claim 1, wherein the two side edges of the base section are each substantially linear and each extend along a substantial entirety of an overall height of the base section.

13. A hanger for supporting a retail item from a separate support structure, the retail item defining an elongated opening a rear surface of the retail item, the elongated opening defining an elongated opening width the hanger comprising:

a support interface portion configured to selectively receive the separate support structure such that the hanger will be suspended from the separate support structure;

a transverse section extending from the support interface portion and defining a bottom edge of the transverse section having a transverse section width that is wider than the elongated opening width;

an intermediate section extending from the transverse section and defining an intermediate section width that is less than the elongated opening width; and a base section extending downwardly from the intermediate section, wherein the base section defines a top edge of the base section adjacent the intermediate section and extends in a direction opposite the intermediate section, the base section defines two side edges tapered toward one another such that a width of the base section gradually decreases as the base section extends away from the intermediate section, the width of the base section at the top edge is larger than the intermediate section width and the elongated opening width, and the base section is configured to partially deflect to slide through the elongated opening such that during use the intermediate section and the base section are positioned on opposite sides of the elongated opening and the intermediate section extends through the elongated opening;

wherein:

the two side edges of the base section are each substantially linear and each extend along a substantial entirety of an overall height of the base section, and the two side edges of the base section converge opposite the intermediate section to define a point.

14. The hanger of claim 1, wherein the base section is continuously solid between the two side edges such that the base section is free from any slits, slots, and openings between the two side edges.

15. The hanger of claim 1, wherein the support interface portion defines a width that is less than half of a width of the transverse section.

16. The hanger of claim 1, wherein the support interface portion is substantially rectangular and defines two opposing side edges each extending along a substantial entirety of a height of the support interface portion and each extending substantially perpendicularly relative to the bottom edge of the transverse section.

17. The hanger of claim 16, wherein the support interface portion includes an aperture for selectively receiving the separate support structure.

18. The hanger of claim 1, wherein:

the width of the base section along a topmost edge of the base section is wider than the intermediate section width to define a portion of the topmost edge of the base section on either side of the intermediate section, and the topmost edge of the base section is adapted to directly interface with the retail item to hold the intermediate section to extend through the elongated opening of the retail item.

19. The hanger of claim 1, wherein:

the support interface portion is substantially rectangular and defines an aperture for selectively receiving the separate support structure, the transverse section is substantially rectangular and defines a transverse section height that is less than the transverse section width, the intermediate section width is less than about half of the transverse section width, and the two side edges of the base section taper toward one another to form a point opposite the intermediate section, and the topmost edge of the base section is partially defined on either side of the intermediate section and is configured to interact with the retail item to maintain the intermediate section of the hanger positioned within the elongated opening of the retail item.

20. The hanger of claim 1, wherein:

the topmost edge of the base section extends beyond each of opposing outermost side edges of the intermediate section, and the topmost edge of the base section is formed in two separate sections with one of each of the two separate sections extending on either side of the intermediate section.

* * * * *